US005674159A

United States Patent [19]

Davidson

[11] Patent Number: 5,674,159

[45] Date of Patent: Oct. 7, 1997

[54] EXERCISE MACHINE FOR ONE OR TWO PERSONS INCORPORATING A SPINNING BODY

[76] Inventor: Randall A. Davidson, 12103 Hindry Ave., Hawthorne, Calif. 90250

[21] Appl. No.: 567,052

[22] Filed: Dec. 4, 1995

[51] Int. Cl.[6] ..... A63B 23/12

[52] U.S. Cl. ..... 482/92; 482/110; 482/904; 446/253

[58] Field of Search ..... 482/82, 92, 110, 482/126, 129, 131, 139, 148, 904, 906; 446/236, 247, 253, 254, 266; 273/414, 424, 453; D21/92, 98, 191, 198

[56] References Cited

U.S. PATENT DOCUMENTS

| | | | |
|---|---|---|---|
| 70,610 | 11/1867 | Porter . | |
| 197,479 | 11/1877 | Lauth . | |
| 418,257 | 12/1889 | Whitely | 482/129 |
| 509,044 | 11/1893 | McCall . | |
| 748,661 | 1/1904 | Scott . | |
| 774,738 | 11/1904 | Chavez | 482/92 |
| 780,571 | 1/1905 | Moore . | |
| 1,605,538 | 11/1926 | Gensicki . | |
| 1,686,890 | 10/1928 | Wood . | |
| 1,965,511 | 7/1934 | Preston | 482/904 |
| 2,716,027 | 8/1955 | Gehri | 482/131 |
| 3,052,060 | 9/1962 | Wohlstrom . | |
| 3,131,506 | 5/1964 | Fox . | |
| 3,214,166 | 10/1965 | Gaudet | 446/247 |
| 3,269,727 | 8/1966 | Samuel . | |
| 3,295,251 | 1/1967 | Tomasello | 446/247 |
| 3,516,195 | 6/1970 | Batley | 446/254 |
| 3,672,094 | 6/1972 | Vigorito . | |
| 3,737,162 | 6/1973 | Wood . | |
| 4,003,575 | 1/1977 | Hobbs . | |
| 4,059,265 | 11/1977 | Wieder et al. | 482/129 |
| 4,705,270 | 11/1987 | Melton | 482/904 |
| 4,953,854 | 9/1990 | Pizur, Sr. . | |
| 5,254,065 | 10/1993 | Pollock | 482/904 |
| 5,512,028 | 4/1996 | Sparks, III | 482/110 |
| 5,549,532 | 8/1996 | Kropp | 482/126 |

FOREIGN PATENT DOCUMENTS

| | | | |
|---|---|---|---|
| 7411535 | 2/1976 | Netherlands | 482/110 |
| 10885 | of 1898 | United Kingdom | 446/253 |
| 11655 | of 1902 | United Kingdom | 446/253 |
| 2066674 | 7/1981 | United Kingdom | 273/453 |

*Primary Examiner*—Jeanne M. Clark

[57] ABSTRACT

An exercise machine for one or two persons incorporating a spinning body (300) mounted intermediately on a pair of ropes (200). At one end of the ropes, dual handgrips (100) afford independent movement to the right and left sides of the body, and can be either held by the hands or worn as stirrups by the feet. At the other end of the ropes, a handlebar (400) can be grasped by a second participant; built into the handlebar is a harness (500) to secure the handlebar to a door for one-person use.

14 Claims, 10 Drawing Sheets

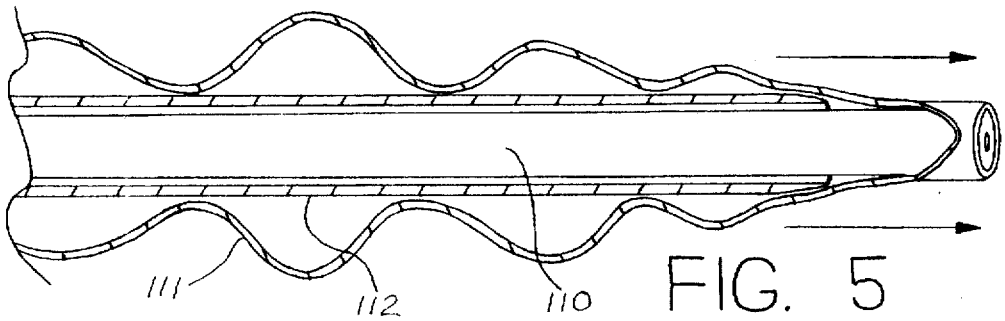
FIG. 5
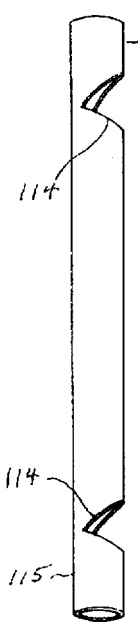
FIG. 6-A
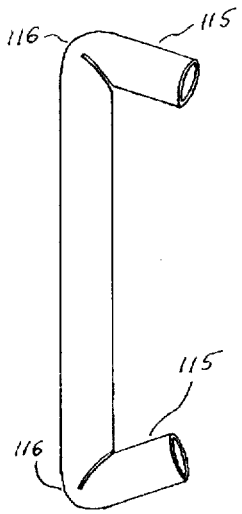
FIG. 6-B
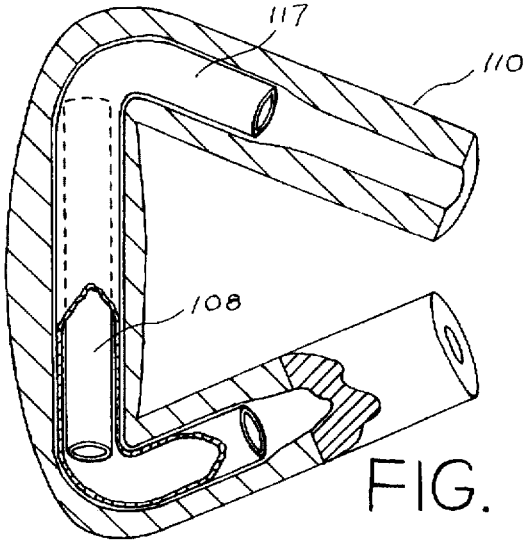
FIG. 7
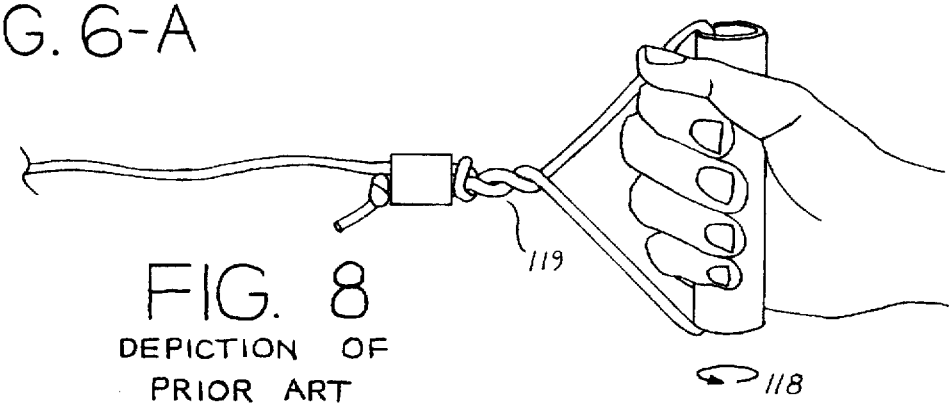
FIG. 8
DEPICTION OF
PRIOR ART

EXERCISE MACHINE FOR ONE OR TWO PERSONS INCORPORATING A SPINNING BODY

FIELD OF INVENTION

This invention relates to improvements in a form of exercise machine that incorporates a spinning body mounted on a pair of ropes with a handle at each end. By manipulating the ropes appropriately, the spinning body is caused to rotate, its inertia providing the muscular resistance useful in obtaining exercise.

DESCRIPTION OF PRIOR ART

The basic idea for this type of exercise machine originates in an old folk-toy commonly known as a "button buzzer". Typically, a piece of string is threaded through a large coat button and the ends of the string are held taut between both hands with the button suspended in the middle. In a rapid pumping motion, the hands are alternately pulled apart and drawn together, causing the button to spin rapidly, first in one direction, then the other. Because the whirling button comes to a halt only briefly in order to reverse direction, the visual effect is one of seemingly continuous motion.

A 1928 patent illustrates an early instance of the button buzzer having been adapted to a form of exercise machine (U.S. Pat. No. 1,686,890 to Wood). To keep the button buzzer in motion requires quick reflexes and good timing, hence there is a certain delight in its use. The insight that a suitably modified button buzzer could thus add an element of playfulness to the otherwise (usually) uninteresting activity of exercise is what has undoubtedly led inventors from the start to adapt the toy into an exercise machine.

Early on, inventors realized this new machine was not limited to providing forearm exercise, like the button buzzer, but could be enlarged and modified for a variety of exercises. U.S. Pat. No. 1,605,538 to Gensicki (1926) illustrates such a machine being used by two individuals, one seated and one standing, who grasp it at opposite ends; unfortunately, a design like this would preclude solo use. To overcome this limitation, U.S. Pat. No. 1,686,890 to Wood (1928) shows how the machine can be attached to a wall, giving the user the option of operating it alone from one end; yet this design suffers from a lack of portability, as well as the possibility that its multiple parts could become separated from the machine and lost.

In later patents, inventors put most of their creative effort into re-designing the spinning body (the part analogous to the coat button), and surprisingly little thought went into improving other basic aspects of the machine. For example, there was much need for improvement in the following areas:

(1) finding a more practical, convenient means of attaching one end to a stationary object, and of easily switching from one-person use to two-person use (and vice-versa);

(2) improving the hand-grips for better comfort; and (3) devising a way to increase the user's range of body motion and to maximize the areas of the body that receive exercise.

This last problem could be solved in large measure by a basic modification to the "button buzzer" design: by substituting a pair of independent handgrips for the typically employed handlebar at one or both ends, the exercise machine becomes much more versatile and the user is enabled to enjoy a much greater freedom of body movement. Unfortunately, previous inventors' designs merely enlarged the button buzzer without attempting to change it in this respect. Although U.S. Pat. No. 1,686,890 to Wood (1928) incorporates a form of dual handgrips, Wood's design also fails to break free from the original "button buzzer" concept, as it requires two spinning bodies, one for each handgrip. Needless to say, this represents a disadvantage in terms of cost, complexity of design, difficulty of operation, etc.

As I have mentioned, most inventors concentrated on developing novel designs for the spinning body, perhaps because of its role as the machine's visual and esthetic focal-point. Among the more interesting examples are:

- a wheel-like structure whose outer rim connects to a central hub by means of fin-shaped spokes (U.S. Pat. No. 3,131,506 to Fox [1964])
- an inflatable rubber ball (U.S. Pat. No. 3,269,727 to Samuel [1966])
- a hollow spheroid composed of two joined, somewhat flattened, cup-like half-shells (U.S. Pat. No. 4,953,854 to Pizur, Sr. [1990]).

Although these designs do a good job of providing the spinning body with an attractive shape (as contrasted, for example, against the very unattractive idea of simply cutting out a thin disc from a sheet of plywood or acrylic plastic, as suggested elsewhere in the literature), they also have certain commercial drawbacks. While the first design offers no suitable surface for the printing of a highly visible logo, the latter designs, owing to their considerable volume, suffer from a lack of portability in terms of the ease with which they may be packed in luggage for use away from home.

OBJECTS AND ADVANTAGES

Accordingly, various objects and advantages of the exercise machine of the present invention are:

(1) to provide the spinning body with an attractive shape;

(2) to provide the spinning body with a large surface suitable for the reception of labelling or print, as for a logo;

(3) to design the spinning body so that the exercise machine can be readily packed in luggage or even into a briefcase;

(4) to enable a user to enjoy as much freedom of body movement during exercise as possible;

(5) to enable as many areas or muscle groups of the body to be exercised as possible;

(6) to make the hand-grips as comfortable as possible;

(7) to provide an easy-to-use, convenient means of attaching one end to a stationary object;

(8) to enable a user to switch readily from one-person use to two-person use, and vice-versa; and (9) to provide a single, integrated piece of equipment without additional parts that could become separated from the machine and lost.

A further object of my exercise machine is to provide a form of exercise that's both fun and healthy. Accordingly, my exercise machine is intended to be pleasurable to operate, psychologically engaging, physically comfortable, and esthetically attractive. Above all, it seeks to avoid the physical drudgery and mental boredom usually associated with most exercise machines.

Still further objects and advantages will become apparent from a consideration of the drawings and ensuing description.

DRAWING FIGURES

FIG. 1 shows the exercise machine being used by two persons.

FIGS. 2–10 relate to the dual handgrips:

FIG. 5 is a cutaway illustrating assembly of the outer sheath with the cushioning tube.

FIG. 6-A shows an alternative embodiment of the rigid tube, and FIG. 6-B shows its extended end-portions in a bent position.

FIG. 7 is a cutaway of an alternative embodiment in which a flexible rubbery tube is interposed between the rigid tube and the cushioning tube.

FIG. 8 shows inferior features of a handgrip design known in the prior art.

Figure 9:
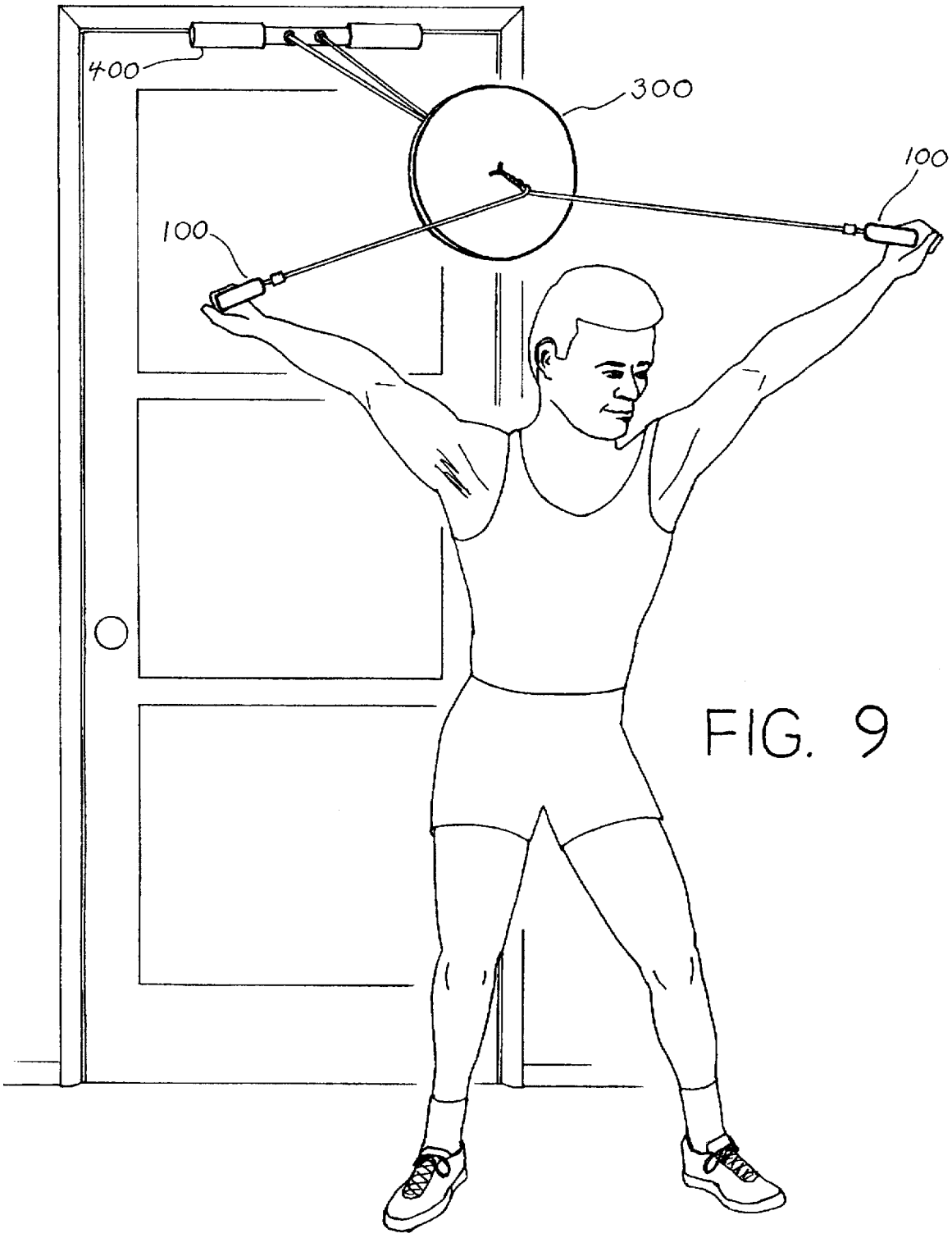

FIG. 9 shows an exercise for the triceps made possible by dual handgrips.

Figure 10:
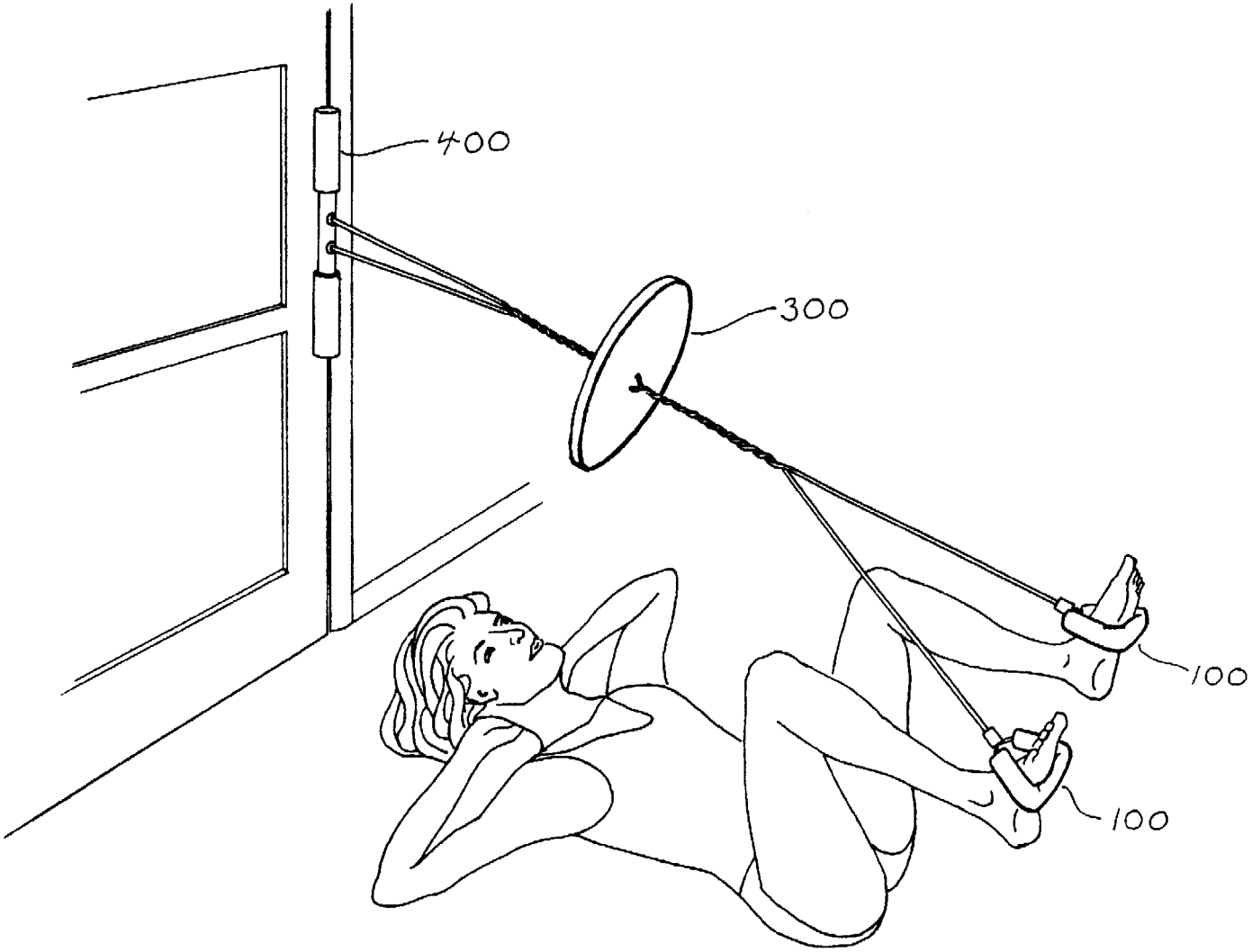

FIG. 10 shows an exercise made possible by using the handgrips as stirrups for the feet.

Figure 11:
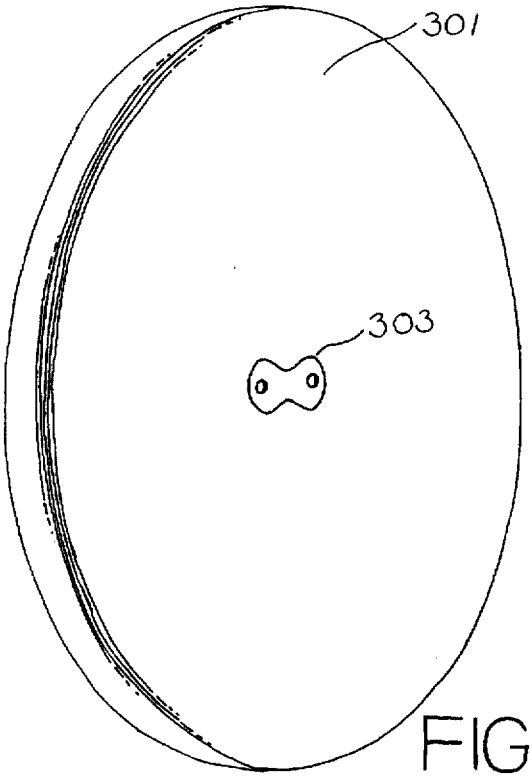

FIGS. 11–15 relate to the spinning body:

FIG. 11 shows the external appearance of the spinning body.

Figure 12:
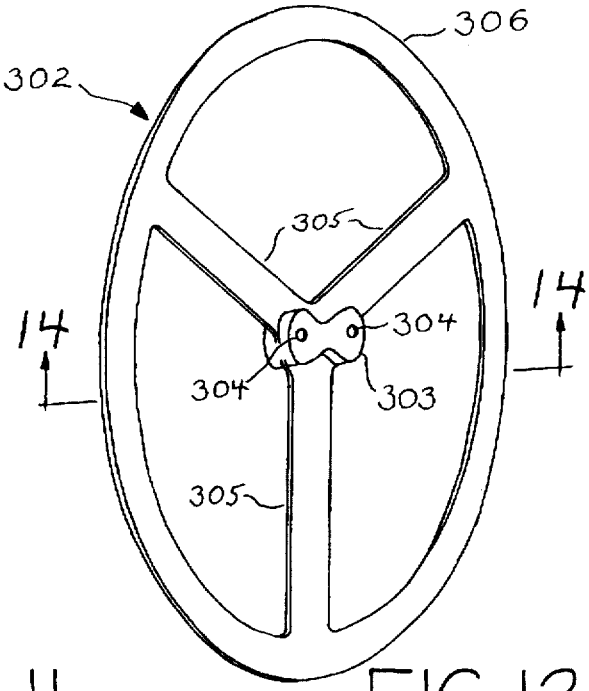

FIG. 12 is a perspective of the foam-reinforcing structure.

Figure 13:
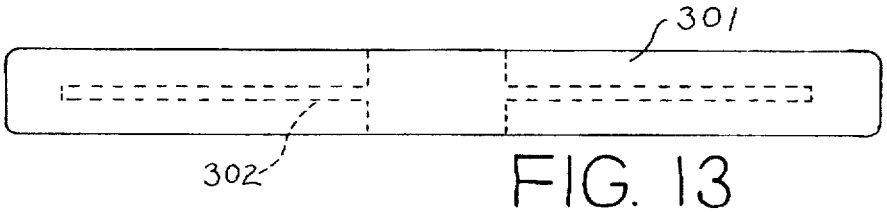

FIG. 13 is a profile of the spinning body, with the foam-reinforcing structure positioned centrally within the outer foam encasement.

Figure 14:
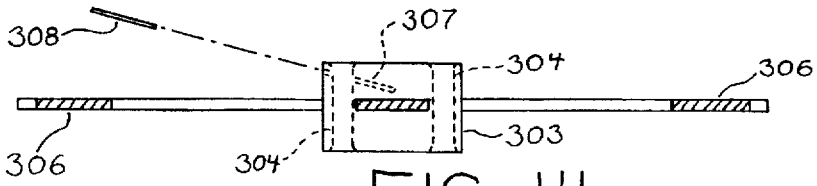

FIG. 14 is a section through line 14—14 of FIG. 12, showing the rope-securing feature.

Figure 15:
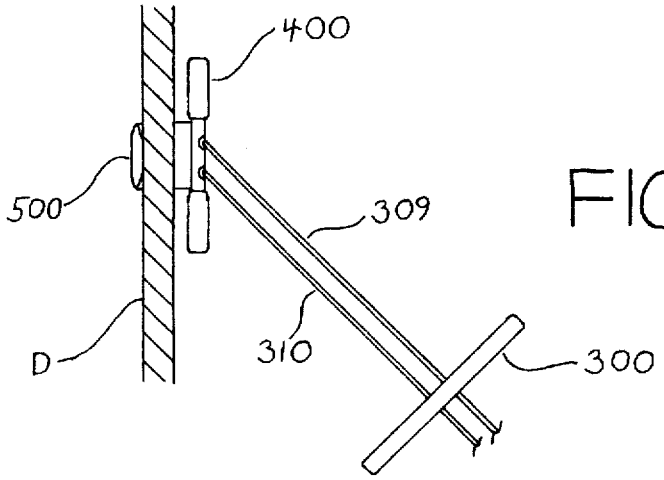

FIG. 15 shows how rope segments between the handlebar and the spinning body acquire different lengths when the spinning body is drawn off at an angle.

Figure 16:
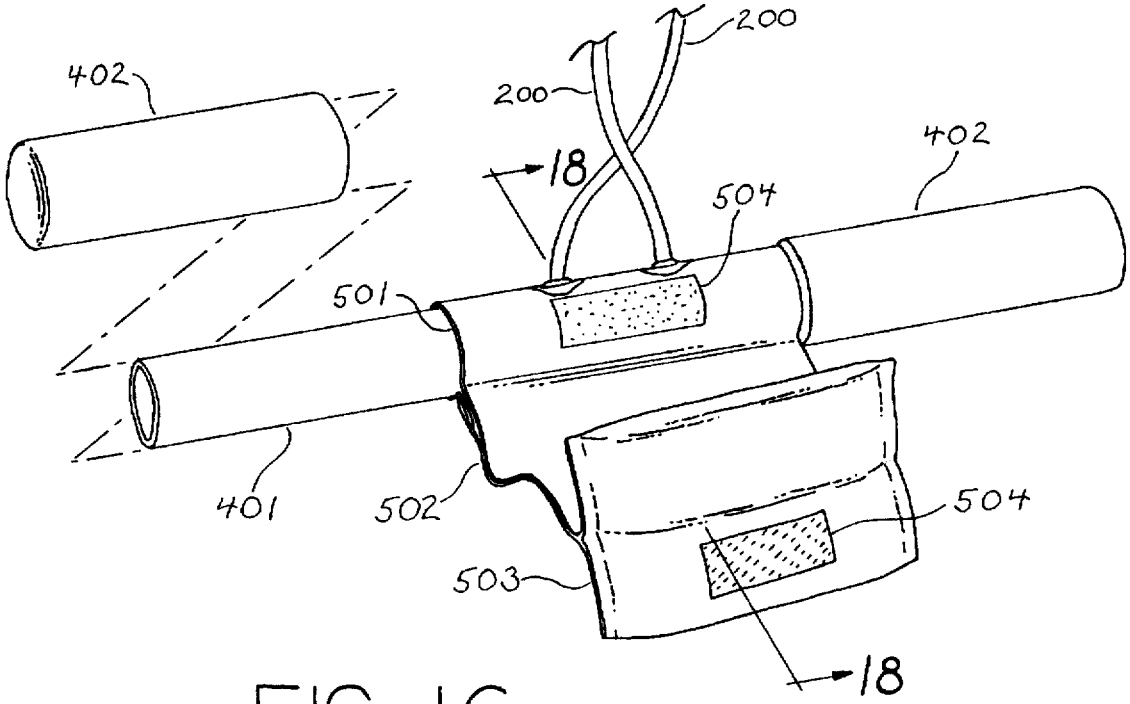

FIGS. 16–21 relate to the handlebar and door harness:

FIG. 16 is a perspective of the handlebar and door harness, with the harness in the unfastened or ready-to-use position.

Figure 17:
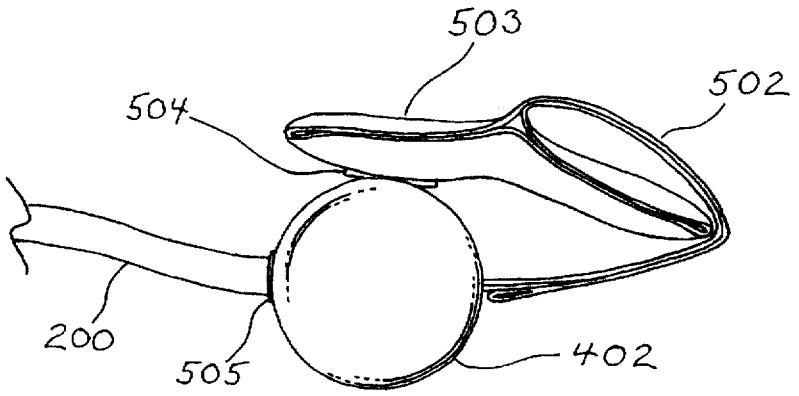

FIG. 17 is a profile showing the harness in the fastened or stowed position.

Figure 18:
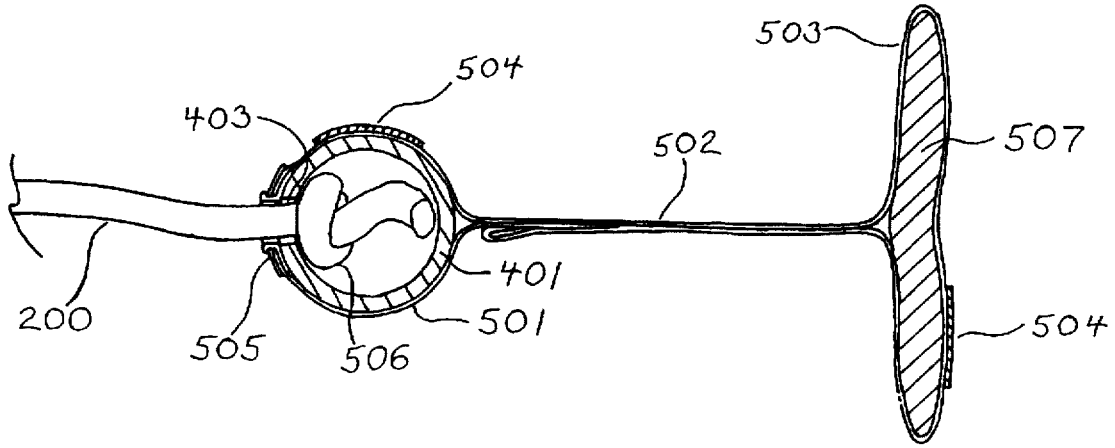

FIG. 18 is a cross-section through line 18—18 of FIG. 16, showing the interior of the handlebar tube and harness check.

Figure 19:
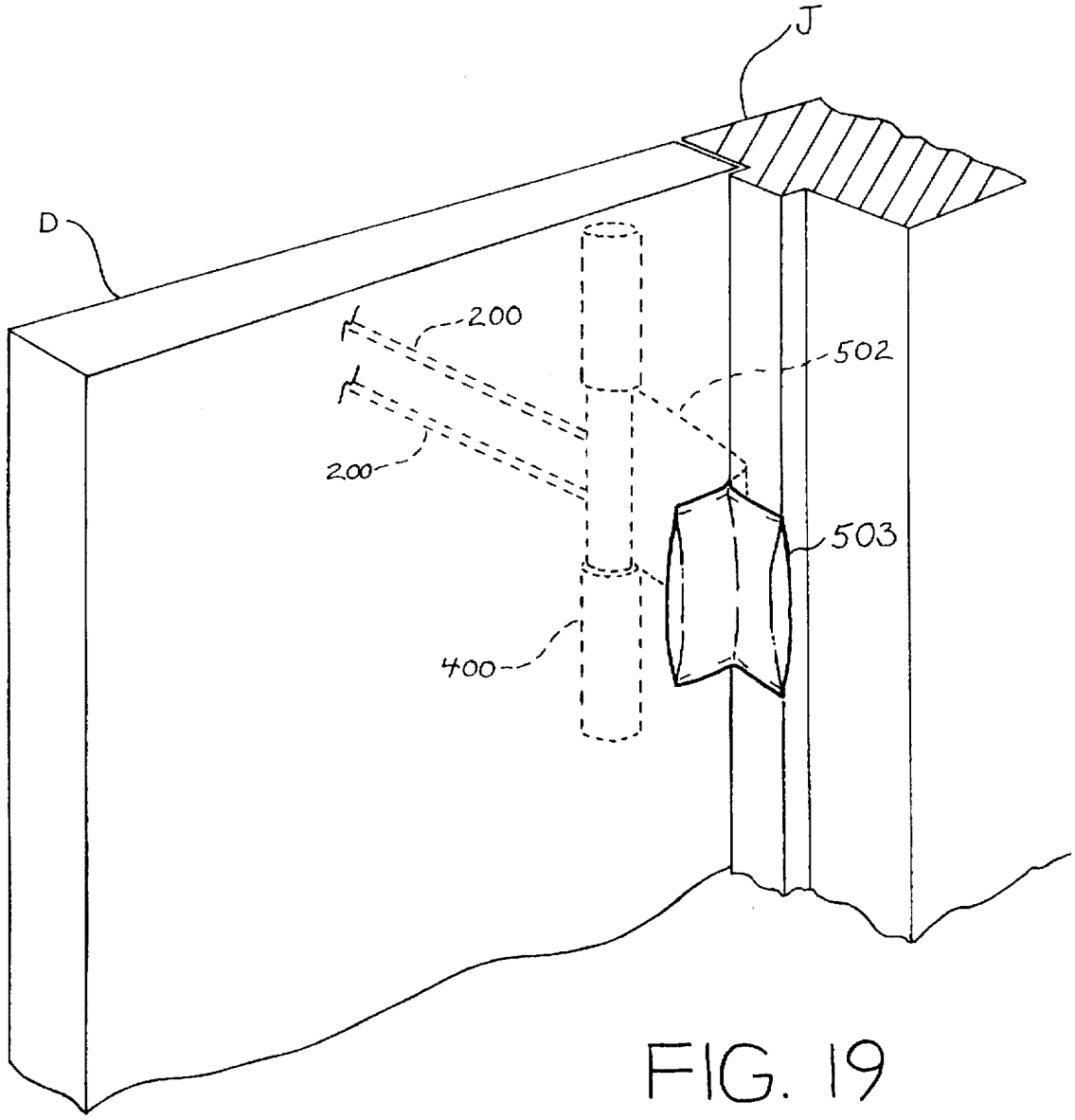

FIG. 19 shows the door harness retaining the handlebar-end of the exercise machine for one-person use.

Figure 20:
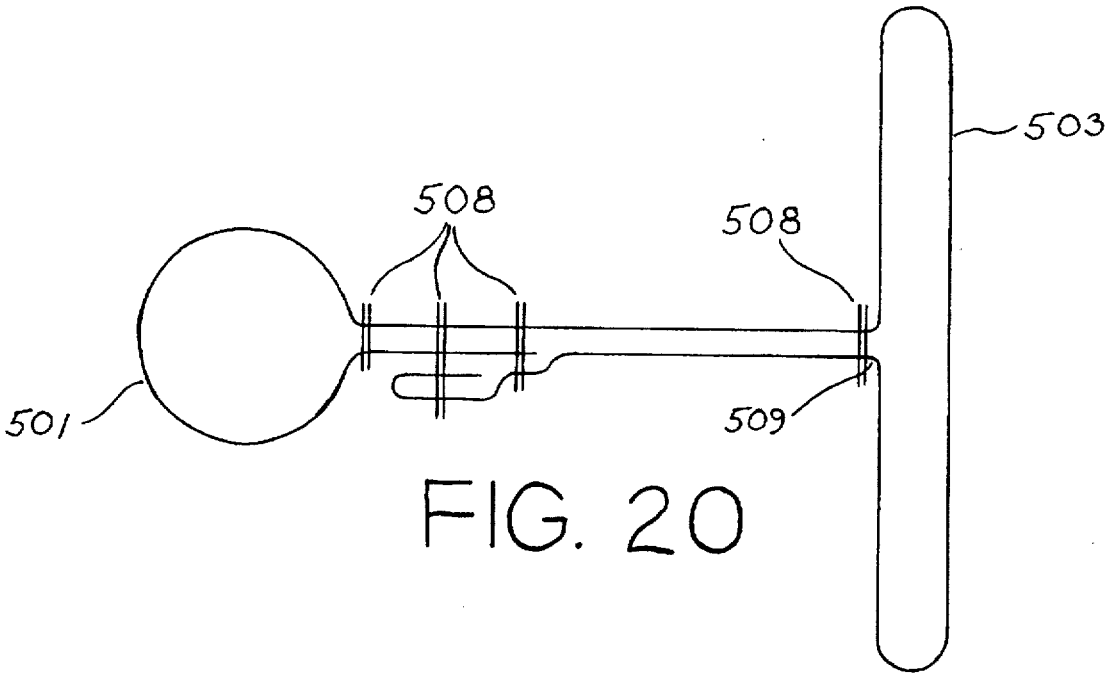

FIG. 20 is a schematic diagram substantially representing the same cross-section as that of FIG. 18, showing the folds of material and location of stitches in the harness strap.

Figure 21:
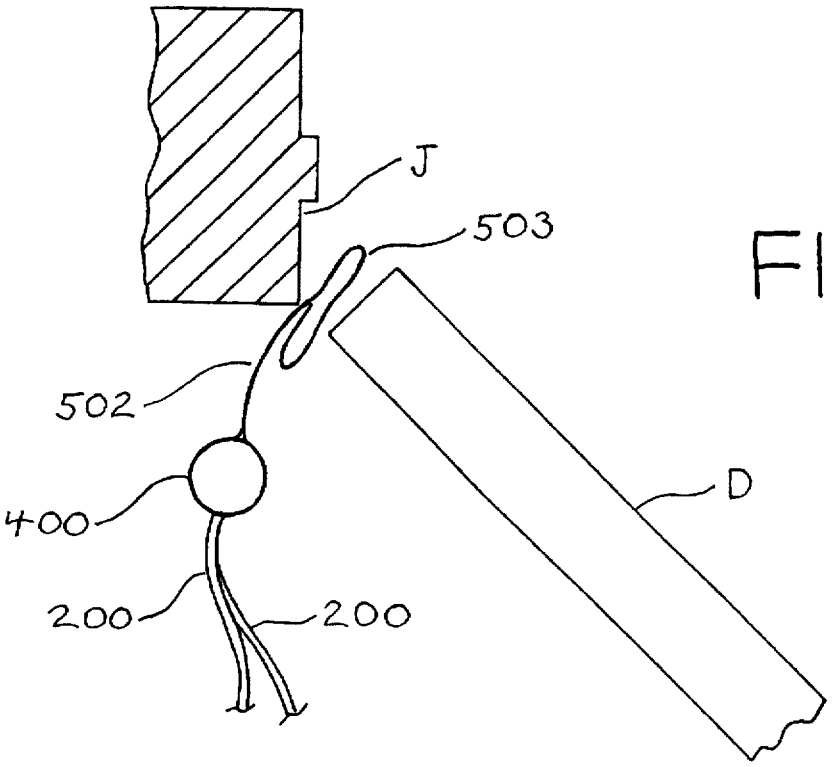

FIG. 21 is an overhead view showing insertion of the harness check through the space between the hinged side of a door and a door jamb.

DESCRIPTION OF THE EXERCISE MACHINE

A. General Description

Figure 1:
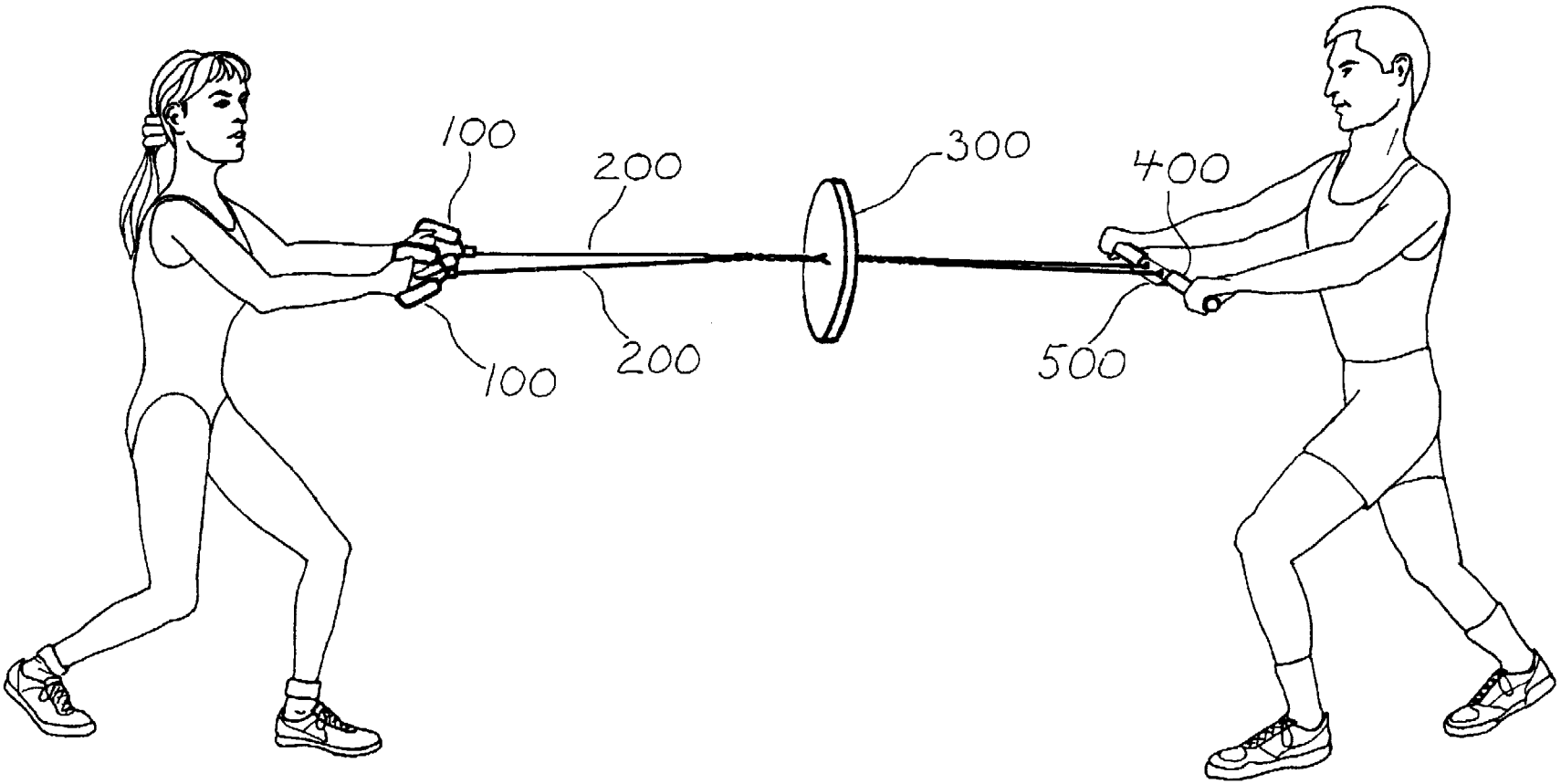

FIG. 1 shows a typical embodiment of the exercise machine of the present invention. At one end of the exercise machine, each of a pair of independent or dual handgrips 100 connects to one of two pieces of rope 200. The ropes, running parallel, stretch to the opposite end of the machine and at approximately their midpoint pass through a spinning body 300. Emerging from the spinning body, the ropes terminate at a handlebar 400 to which they both connect; incorporated into the handlebar is a door harness 500.

B. Dual Handgrips

Figure 2:
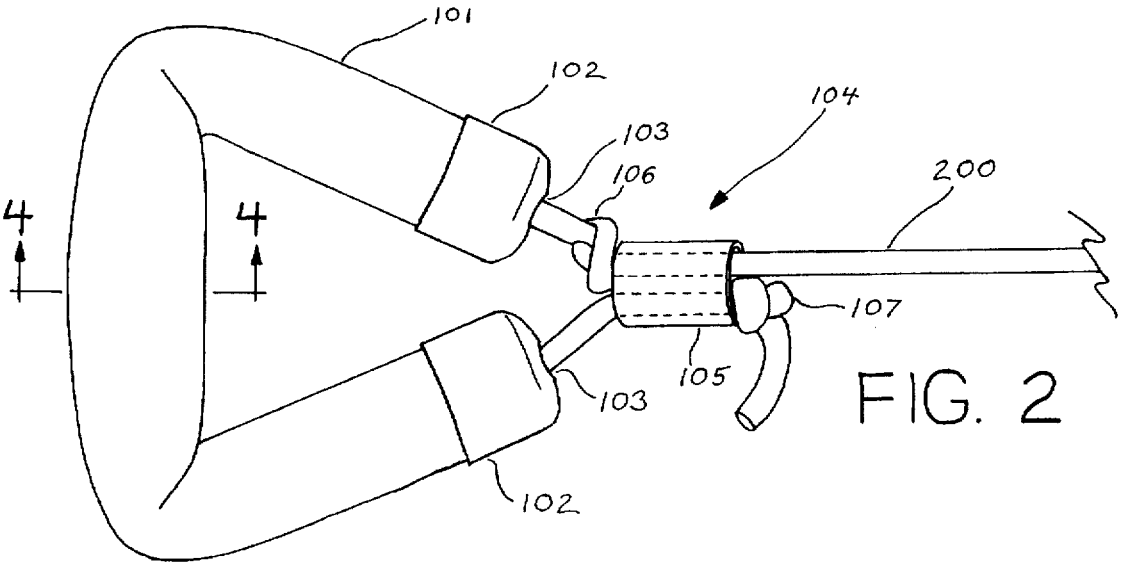
FIG. 2 shows the external appearance of a handgrip.

The two independent or dual handgrips 100, which can be grasped by the right and left hands of a user, are identical in construction. FIG. 2 shows the handgrip's external appearance.

A cushioned grip 101 is covered at each end by a cosmetic end-cap 102 having a hole 103 through which rope can pass. One of the two ropes 200 that come from the spinning body passes through the cushioned grip, entering it through one end-cap and exiting it through the other. By fashioning the rope into a loop and securing it by a knot arrangement 104, the cushioned grip is formed into a horseshoe shape suitable for grasping by a user.

The details of the knot arrangement are also shown in FIG. 2. A rigid piece of tubing of small enough inside diameter to prevent the knotted ropes from slipping through it forms a knot-stop 105; PVC tubing works well for this. One of the ropes 200 that comes from the spinning body passes into the knot-stop and, upon exiting, forms a knot 106. Continuing from knot 106, the rope forms a loop through cushioned grip 101 and passes back through the knot-stop a second time, forming a knot 107 as it exits. Thus the rope itself provides the basic, underlying structure of the handgrip.

Figure 3:
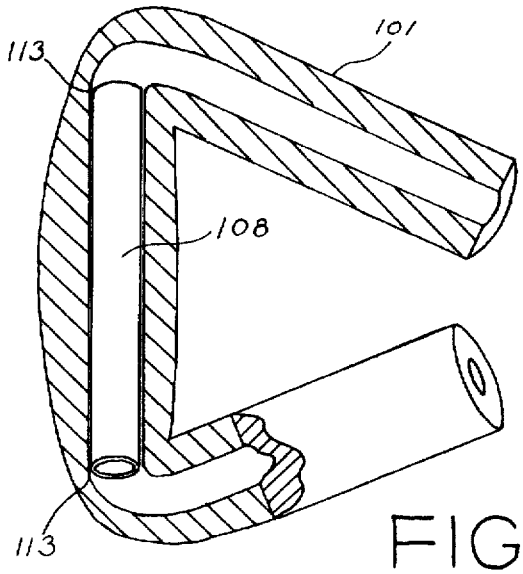
FIG. 3 is a cutaway showing the interior of the cushioned grip, revealing the rigid tube inside.

FIG. 3 is a cutaway showing the position of a rigid tube 108 within cushioned grip 101. Rope 200 (not shown) passes through the rigid tube, and the rigid tube distributes pressure from the rope evenly against the user's hand. The rigid tube can be made, for example, of any suitably stiff plastic.

Figure 4:
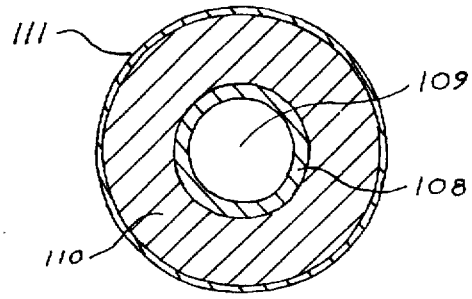
FIG. 4 is a cross-section through line 4—4 of FIG. 2 showing the radial layering of components in the cushioned grip.

FIG. 4 is a cross-section taken on the plane indicated by section line 4—4 of FIG. 2, showing the radial layering of materials that form cushioned grip 101. Innermost is a hollow cavity 109 through which rope can pass, the cavity wall being formed by rigid tube 108. The next-outer layer consists of a cushioning tube 110 whose material is compressibly resilient so as to provide comfort to the user's hand; neoprene tubing such as that used as insulation in refrigerators is probably adequate, but a foam-like material less prone to rips and tears, if not too expensive, would be better. Finally, an outer sheath 111, consisting of a durable, synthetic, slightly stretchy fabric, provides an esthetically agreeable texture and appearance, at the same time protecting the materials inside from damage.

Outer sheath 111 is constructed by folding, edge-to-edge and lengthwise, the above-described fabric so it forms a sheath or tube when the two edges are sewn together; to conceal the fabric's edges along the seam, the sheath is turned inside-out. FIG. 5 is a cutaway showing a method of assembling the sheath with cushioning tube 110. To ease assembly, sheath 111 is slipped temporarily over a mating tube 112; to facilitate this operation, the mating tube's outer surface is very smooth (e.g., polished metal) and may even be coated with a friction-reducing substance such as polytetrafluoroethylene (PTFE). In addition, the mating tube's inside diameter is just large enough to allow cushioning tube 110 to be inserted. When the cushioning tube is drawn out of the mating tube at the same time as the sheath is pulled off the mating tube (indicated by arrows in the diagram), the cushioning tube and the sheath come together or "mate" in their proper relationship.

If the cushioning tube is made from a relatively delicate material such as neoprene, then a potential source of wear is its compression against a cut edge 113 of rigid tube 108, as shown in FIG. 3. To overcome this problem, FIGS. 6-A and 6-B depict an alternative design of the rigid tube. The tubing is of somewhat greater length than that of rigid tube 108 and has two notches 114 which permit the tubing's extended end-portions 115 to be bent so as to form two elbows 116. The smooth curve of the elbows is thus less likely to tear or damage the cushioning tube than cut edge 113 in FIG. 4.

FIG. 7, depicts yet another design for dealing with this problem, wherein rigid tube 108 is inserted into a flexible rubbery tube 117 of greater length than the rigid tube, and this two-piece assembly is then placed in cushioning tube 110. "Elbows" analogous to elbows 116 in FIG. 5 are thereby formed by the bent ends of the flexible rubbery tube.

Accordingly, several objects and advantages arise in the handgrip design. First, by using rope (a material already comprising a substantial portion of the exercise machine) as the handgrip's basic structure, the cost of manufacturing a special grip by, say, injection molding, and the ensuing problem of integrating it with comfortable foam padding, are neatly obviated.

In addition, by encasing the rope with a suitably long cushioned grip which is bent into a horseshoe shape, as opposed to using a shorter, straight piece of handle-tubing that would cover only enough rope to provide a grip for the user, as illustrated in FIG. 8, two special advantages related to comfort are achieved:

1. the handgrip is prevented from rotating on the rope (as indicated by a circular arrow 118), which eases the amount of strain required to grasp the handgrip effectively during exercise; and
2. the torque generated within the rope by the spinning body is prevented from causing a twisting 119 of the loop of rope that forms the handgrip, which would pinch down upon the back of the user's fingers.

Thus, as well as padding the handgrip, the cushioned grip provides comfort to the user in subtle yet not unimportant ways.

Further, there are special advantages particular to the dual-handgrip arrangement, which is unique to the present invention. In the prior art, both of the ropes that pass through the spinning body are connected to a single handle or handgrip at each end, much as with the single handlebar at one end of my own machine. By my incorporating two independent handgrips at one end, important advantages of body motion and muscle use are attained.

FIG. 9 illustrates one of the new way possible by the made possible by the dual-hand grip arrangement. The user stands with his hands above his head and pushes out to the side while pivoting his arms at the shoulder. Such an exercise, while valuable for strengthening the triceps, is made possible only by means of dual handgrips.

A second new method of exercise, which is for the legs, is provided by lying on one's back and inserting one's feet into the handgrips, as shown in FIG. 10. Because the handgrips' horseshoe-shaped cushioning fits snugly yet comfortably around the feet, the grips stay conveniently in place, permitting an easy manipulation that would be clumsy at best with, for example, a handlebar design. In addition, the dual handgrips provide each leg with independent freedom of motion, which enhances both the physical benefits and the psychological pleasure derived from use.

C. Spinning Body

Spinning body 300 assumes a simple disc shape, comprising two main parts:

1. in the exterior view of FIG. 11, an outer foam encasement 301, made of a synthetic foam, such as polyurethane, preferably of the closed-cell type to resist water absorption (for use near swimming pools, etc.); and
2. in FIG. 12, an inner foam-reinforcing structure 302, made of a stiff but not brittle plastic.

In the foam-reinforcing structure, a reinforced hub 303 has two holes 304 through which the pair of ropes 200 can pass, the holes being spaced equally and on opposite sides from the foam-reinforcing structure's geometric center. Radiating from the hub are three broad, flat spokes 305 connecting to a broad, flat rim 306. As spinning body 300 accelerates in response to the user pulling at the ropes, considerable stress is transferred from the ropes to the reinforced hub; the stress is then distributed evenly throughout foam encasement 301 by the spokes and rim. Without this arrangement, the relatively delicate foam encasement would immediately break apart at the hub. In addition, the spokes and rim prevent the foam encasement from disintegrating at the periphery due to the very large centrifugal (outward-radiating) forces generated during use.

FIG. 13 is a profile of the spinning body, showing the foam-reinforcing structure positioned centrally within the foam encasement. The foam-reinforcing structure is entirely concealed by the foam encasement, except for the flat top and bottom surfaces of reinforced hub 303, best seen in the external view of FIG. 11.

FIG. 14 is a view of the foam-reinforcing structure taken on the plane indicated by section line 14–14 in FIG. 12. Reinforced hub 303 contains a slot 307 into which a pin 308 can be inserted. The slot is arranged so that the pin, when fully inserted, passes through one of the two rope holes 304 in order to pierce one of the two ropes 200. This keeps the spinning body from sliding or changing its position on the rope, as the exercise machine works best if the spinning body is situated approximately half-way between the ends of the rope. (Alternatively, instead of a pin, cement or molten thermoplastic could be used to bond the rope to the spinning body.)

Significantly, the other rope 200 is not similarly secured, but is left free to slide through hub 303 of the spinning body; this enables the ropes to wind and unwind evenly under certain conditions. For example, as in FIG. 15, if spinning body 300 is drawn away from handlebar 400 at an angle, then the length of rope segment 309, which is fixed by pin 308, remains the same, while rope segment 310 is effectively shortened by sliding through the spinning body. If rope segment 310 had also been fixed in its length, then instead of shortening it would have gone slack as rope segment 309 remained taut, resulting in poor operation.

Several objects and advantages are achieved by the spinning body's design. First, its thickness (approx. 2.5 cm in the preferred embodiment) gives it a pleasing appearance and prevents it from being mistaken for a cheap-looking cut-out of plywood or acrylic plastic. Despite its volume or bulk as compared with a thin plywood or acrylic plastic cut-out, the choice of material (a light-weight foam) keeps the spinning body from getting too heavy for the exercise machine to be operated by a typical adult. (Detailed specifications for optimal operation follow in Section E, below.)

At the same time, the spinning body's design offers two more valuable features:

1. its broad, flat face presents an ideal surface for the printing of a logo; and
2. its size and shape allow the exercise machine to be easily packed in luggage or even slipped into a briefcase.

Finally, none of the above features would be possible without a structurally sound design. The foam-reinforcing structure is singly responsible for the spinning body's structural integrity and durability; without it, the spinning body would be ripped apart by the considerable stresses imposed on it during use.

D. Handlebar and Door Harness

FIG. 16 illustrates the combination handlebar 400 and door harness 500. The handlebar comprises a handlebar tube 401 and two handlebar grips 402, one on each end of the handlebar tube; one of the grips has been removed to reveal the handlebar tube underneath. The handlebar tube can be made of any suitably strong material, such as polyvinylchloride (PVC).

In the middle portion of the handlebar tube, between handlebar grips 402, the door harness is attached by means of a sleeve 501 that fits around the handlebar tube. A harness strap 502 extends from the sleeve to a harness check 503. In addition, a set of hook-and-loop fasteners 504 is attached to the sleeve and to the check to enable the check, along with the strap, to be rolled up and temporarily fastened against the sleeve in an out-of-the-way position when the door harness is not being used; this position is illustrated in profile in FIG. 17.

FIG. 18 is a cross-section through the plane indicated by section line 18—18 of FIG. 16, showing the attachment of the ropes to the handlebar. On entering the handlebar, each rope 200 passes first through a grommet 505 in harness sleeve 501; the grommet should preferably be bent so as to conform to the contour of the handlebar tube. Next, each rope passes through a hole 403 that has been drilled in the handlebar tube. Finally, each rope terminates with a knot 506 that prevents the rope from being pulled out of the handlebar tube. In passing first through the sleeve, the ropes serve the secondary purpose of holding the harness in place by preventing the sleeve from sliding back and forth on the handlebar tube.

FIG. 18 also illustrates the T-shaped profile of the harness made by the union of the check and the strap. The T-shape provides the check with a substantial surface area for a door and a door jamb to abut. The surface area is actually greater than normally necessary for the harness to work well, but the excess allows for an added measure of security.

Also illustrated in FIG. 18 is the interior of the harness check, which is occupied by a harness check filler 507. The filler is a material that resists compression so as to prevent the check from squeezing through the space between a door and a door jamb during use. At the same time, it can flex so as to conform to the right angle made by a door D and a door jamb J as illustrated in FIG. 19. A dense closed-cell foam is suitable.

To simplify the harness's construction, the sleeve, the strap, and the outer covering of the check are made from the same, continuous piece of material; nylon strapping material, similar to the material used for straps in bicycle helmets, works well. FIG. 20 is a schematic diagram that shows where the strapping material is folded and stitched, representing a cross-section substantially the same as that of FIG. 18. Stitches 508 are made where indicated. To complete construction of the harness, the harness check filler is inserted and the sides of the harness check are sewn up to hold the filler in place.

FIG. 20 also indicates a joint 509 having been formed between the check and the strap. This joint acts as a hinge, permitting the T-shaped harness to flex so that a user can easily insert the check between opened door D and door jamb J, as shown in the overhead view of FIG. 21.

Finally, for the door harness to work well, it must not only securely attach the exercise machine to a door, but it must also counter the tendency of the handlebar to spin like an airplane propeller in response to the rotation of the spinning body and the coiling of the ropes. To prevent this undesirable effect, several considerations must be met:

1. The moment of rotation exerted by the ropes on the handlebar must be minimized. This is accomplished by positioning the holes that receive the ropes into the handlebar tube as close together as possible, but not so close as to jeopardize the handlebar tube's ability to withstand strain from the pulling of the ropes.
2. The harness's strapping material must be wider than the spacing of the holes in the handlebar tube, a width of 15 cm, for example, not being excessive.
3. The harness strap, in extending from the sleeve to the check, must be as short as possible, yet long enough to permit a user readily to insert the check between a door and a door jamb.

Accordingly, the design of the combined handlebar and door harness affords several objects and advantages:

1. it provides an extremely easy, convenient way of securing one end of the exercise machine to a stationary object (a door) for in-home solo use;
2. the handlebar and door harness are an integrated unit, which means there are no additional parts that can get separated from the machine and lost;
3. because the handlebar and door harness are an integrated unit, the user is spared the trouble of connecting or disconnecting separate pieces in order to switch between one-person and two-person use;
4. the T-shaped harness provides greater security in attaching the exercise machine to a door than a harness with a narrower check, yet easily pivots out of the way for quick installation or removal; and
5. the door harness holds the handlebar steadily in-place and keeps it from spinning like an airplane propeller in response to the motion of the spinning body.

E. Miscellaneous Specifications

The following specifications are suggested as a set of specifications to accomodate a typical adult user; many other sets of specifications are possible to achieve similar results.

Spinning Body:

diameter: 28 cm thickness: 2.5 cm mass: 0.370 kg spacing of holes through hub: 1.8 cm Ropes:

length (from handlebar to handgrips): 165 cm thickness: 0.80 cm (5/16 inch)

type: solid-braid, multi-filament polypropylene

OPERATION OF THE EXERCISE MACHINE

During one-person operation, the door harness holds the handlebar end of the machine in a stationary position; the user grasps the dual handgrips at the opposite end.

The basic technique is for the user to commence operation by giving the ropes a little twist by turning the spinning body by hand in one direction (say, clockwise). The user, grasping the handgrips, then pulls on the ropes, which forces them to unwind and causes the spinning body to rotate counter-clockwise. As the ropes become fully unwound, the user relaxes her pull, and the continuing rotation of the spinning body causes the ropes to rewind (counter-clockwise); after which the operation may be repeated any number of times. The result is an agreeable cycle of effort and relaxation in which the amount muscular force applied by the user follows a smoothly varying curve.

During two-person operation, one person grasps the dual handgrips and the other person grasps the handlebar. The operation is substantially the same as described above, but with both individuals performing the steps in synchrony.

A variation on the basic technique, made possible by the dual handgrips, is for the user to force the handgrips apart instead of drawing them in tandem. For example, the user can push one outward to the right and the other outward to the left. Alternatively, the user can hold one handgrip in a stationary position while moving the other one away from it (downward, for example).

A great variety of exercises can be built upon the basic technique. For instance, while the machine is good for aerobics, it can also be used for the non-aerobic activities of biceps curls, stomach crunches, and deep knee-bending squats. In addition, it enables a user to stretch and tone muscles in virtually every part of the body, including arms, legs, back, shoulders, chest, and abdomen. Further, because the user's body movement is not limited by mechanically restrictive devices such as levers and hinges, the exercise machine lends itself to the exploration of forms which may be freely invented by the user.

SUMMARY, RAMIFICATIONS, AND SCOPE

Accordingly, the reader will see that the exercise machine of this invention provides a total-body workout while also enabling the user to enjoy great freedom of body movement. This is largely owing to the dual handgrips, wherein each handgrip is also designed to provide the user with maximum comfort.

In addition, the door harness provides a convenient means of attaching one end of the exercise machine to a stationary object for solo workouts. Combined with the handlebar, the door harness enables a user to switch easily between one-person and two-person use, without the inconvenience of having to attach or detach additional parts. Further, the integrated design means there are no separate parts that can become lost or misplaced.

Finally, the exercise machine has additional advantages in that

- the spinning body provides a surface well-suited to the printing of a logo;
- the spinning body's size and shape make the exercise machine portable in luggage or even a briefcase; and
- the spinning body simultaneously combines the elements of
  - an attractive appearance;
  - suitable rotational inertia for an adult seeking exercise; and
  - a durable, stress-resistant structure.

Although the description above contains many specificities, these should not be construed as limiting the scope of the invention but as merely providing illustrations of some of the presently preferred embodiments of this invention. For example, the spinning body can have other shapes, such as octagonal, oval, or even an amorphous, nongeometric shape, as long as its center of mass lies midway between the two rope-holes in the hub in any cross-section normal to the axis of rotation; the spinning body can be reduced in size and have whistles built into it for use as a child's toy; dual handgrips can be attached at both ends instead of one; the foam-reinforcing structure of the spinning body can have two or four spokes instead of three; the ropes can be nylon instead of polyproylene; etc.

Thus the scope of the invention should be determined by the appended claims and their legal equivalents, rather than by the examples given.

I claim:

1. An exercise machine comprising a spinning body, a first handgrip set, a second handgrip set and rope, wherein the spinning body has an axis of rotation, the spinning body has a property of mass, and the mass of the spinning body is distributed about the axis of rotation in a manner adapted to enable the spinning body to spin about the axis evenly or smoothly or without jiggling, two holes penetrate the spinning body, and the holes lie substantially close to and on opposite sides of the axis of rotation, the rope includes two lengths with each length passing through a respective hole in the spinning body, the mass of the spinning body with its holes in combination with the rope enable spinning of the spinning body about the axis of rotation, the two lengths of rope connect the first handgrip set on one side of the spinning body to the second handgrip set on the opposite side of the spinning body, at least one of the handgrip sets comprises a pair of handgrips, each individual handgrip of said pair of handgrips connecting to each one of said two lengths of rope respectively, whereby independent freedom of movement is provided to the right and left sides of a user's body and each individual handgrip of said pair of handgrips comprises a loop of rope formed by the end-portion of one of said two lengths of rope, a rigid tube through which said loop of rope passes, a hand-cushioning tube of greater length than said rigid tube and of sufficient inside diameter for said rigid tube to be slipped inside it, said rigid tube being centered with respect to said hand-cushioning tube's length, with the hand-cushioning tube's length extending substantially over the perimeter of the loop, and a rope-securing means for securing the rope to itself in order to form said loop of rope, wherein the end-portions of said hand-cushioning tube, unencumbered by said rigid tube held within it, are caused to bend so that said hand-cushioning tube forms a horseshoe shape adapted for being grasped by a hand of a user or worn as a stirrup.

2. The exercise machine of claim 1, further including an extension for each end of the rigid tube and two means for bending the extensions, wherein said extensions provide space between them for an unbent middle section of such length as adapted to be gripped by a clenched hand of a user, said two means for bending work in combination with the unbent middle section and the two extensions, and said two means for bending enable the two extensions to bend so that if imaginary lines projected from the bent extensions they would meet at the same point in space, whereby the resulting two bends or elbows provide a smoothly curved surface to minimize wear or damage to the inside of said hand-cushioning tube.

3. The exercise machine of claim 2, wherein said two means for bending comprise wedge-shaped notches in said rigid tube.

4. The exercise machine of claim 1, further including a flexible rubbery tube of greater length than said rigid tube, said flexible rubbery tube being interposed between said rigid tube and said hand-cushioning tube, said rigid tube being positioned centrally with respect to the flexible tube's length, so that the end-portions of the flexible tube, unencumbered by said rigid tube held within it, can bend and form elbows to provide a smoothly curved surface to minimize wear or damage to the inside of said hand-cushioning tube.

5. An exercise machine comprising a spinning body, a first handgrip set, a second handgrip set and rope, wherein the spinning body has an axis of rotation, the spinning body has a property of mass, and the mass of the spinning body is distributed about the axis of rotation in a manner adapted to enable the spinning body to spin about the axis evenly or smoothly or without jiggling, two holes penetrate the spinning body, and the holes lie substantially close to and on opposite sides of the axis of rotation, the rope includes two lengths with each length passing through a respective hole in the spinning body, the mass of the spinning body with its holes in combination with the rope enable spinning of the spinning body about the axis of rotation, the two lengths of rope connect the first handgrip set on one side of the spinning body to the second handgrip set on the opposite side of the spinning body, the spinning body comprises an external surface formed by an outer encasement of synthetic foam having predetermined mass and shape, and an inner foam-reinforcing means that contains said two holes that penetrate the spinning body, the foam-reinforcing means transfers stress during operation from the ropes to the foam encasement and distributes it evenly throughout the foam encasement in order to improve the structural integrity of the foam encasement, the synthetic foam substantially forms the external shape and appearance of the spinning body, and the synthetic foam is injection-molded around the inner foam-reinforcing means.

6. The exercise machine of claim 5, said inner foam-reinforcing means comprising a structure wherein said two holes pass through a central hub, the hub connects to a predetermined number of broad, flat spokes, and the spokes connect to a broad, flat rim at the periphery.

7. The exercise machine of claim 5, wherein said spinning body is disk-shaped to permit easy storage in travelling bags and has a substantially solid or unperforated face adapted to provide a broad surface on which to print a logo.

8. The exercise machine of claim 5, wherein an anti-sliding means secures the spinning body to a fixed and approximately intermediate point on one and only one of the lengths of rope by preventing the rope from sliding back and forth in the hole through which it passes, whereby smooth winding and unwinding of the rope is obtained under certain operating conditions.

9. An exercise machine comprising a spinning body, a first handgrip set, a second handgrip set and rope, wherein the spinning body has an axis of rotation, the spinning body has a property of mass, and the mass of the spinning body is distributed about the axis of rotation in a manner adapted to enable the spinning body to spin about the axis evenly or smoothly or without jiggling, two holes penetrate the spinning body, and the holes lie substantially close to and on opposite sides of the axis of rotation, the rope includes two lengths with each length passing through a respective hole in the spinning body, the mass of the spinning body with its holes in combination with the rope enable spinning of the spinning body about the axis of rotation, the two lengths of rope connect the first handgrip set on one side of the spinning body to the second handgrip set on the opposite side of the spinning body, and one of the handgrip sets comprises in combination a handlebar and a door harness, wherein the handlebar includes a length of tubing having end-portions adaptably spaced for being gripped by the hands of a user, the door harness includes a sleeve, a strap, and a check, the sleeve is substantially shorter than the length of the handlebar, the door harness connects to the mid-length portion of the handlebar by means of the sleeve which fits snugly around the circumference of the handlebar, one or more holes or openings are provided in the sleeve to allow the two lengths of rope to connect to the handlebar, and the strap connects the sleeve to the check, whereby the check may be inserted through the space between a door and a door jamb so that, when the door is securely closed, the handlebar is held in place for one-person operation.

10. The exercise machine of claim 9, wherein the two lengths of rope join the handlebar substantially close to its longitudinal center, the strap is substantially wider than the spacing of the ropes, and the strap, in extending from the sleeve to the check, is adapted to be barely long enough to allow the check to be easily slipped between a typical door and a door jamb by a user, whereby the handlebar is prevented from twisting back and forth or spinning like an airplane propeller during one-person operation.

11. The exercise machine of claim 9, wherein the sleeve is held in place and prevented from slipping about on the handlebar by the two lengths of rope that join the handlebar passing through said holes in the sleeve.

12. The exercise machine of claim 9, further including two handlebar grips, each of which covers a respective end-portion of the handlebar, and which help hold the sleeve in place and prevent it from slipping about on the handlebar.

13. The exercise machine of claim 9, wherein the sleeve, the strap, and the outer cover of the check are formed of the same, continuous piece of material.

14. The exercise machine of claim 9, wherein a two-piece fastening means is attached to the check and to the sleeve, whereby the check, along with the strap, can be rolled up and temporarily fastened against the sleeve in an out-of-the-way position when the door harness is not being used.

* * * * *